United States Patent [19]

Thomas

[11] 4,085,763

[45] Apr. 25, 1978

[54] QUAD CANE

[75] Inventor: Morton I. Thomas, Nyack, N.Y.

[73] Assignee: Temco Products, Inc., Passaic, N.J.

[21] Appl. No.: 719,741

[22] Filed: Sep. 2, 1976

Related U.S. Application Data

[63] Continuation-in-part of Ser. No. 683,978, May 6, 1976, Pat. No. 4,056,115.

[51] Int. Cl.[2] ..... A45B 9/04

[52] U.S. Cl. ..... 135/69; 135/75; 248/409; 248/413; 403/108; 403/109; 403/324; 403/328

[58] Field of Search ..... 135/69, 75; 403/33, 403/108, 109, 322, 324, 328; 248/408, 409, 4, 413

[56] References Cited

U.S. PATENT DOCUMENTS

| | | | |
|---|---|---|---|
| 777,113 | 12/1904 | Lester | 403/324 |
| 1,322,084 | 11/1919 | Bemis | 135/69 |
| 1,870,921 | 8/1932 | Murka | 135/69 |
| 2,630,128 | 3/1953 | Slater | 135/69 |
| 2,759,525 | 8/1956 | Ries | 135/67 |
| 2,842,387 | 7/1958 | Della-Porta | 403/324 |
| 3,289,685 | 12/1966 | Parker | 135/65 |
| 3,553,746 | 1/1971 | Seiger | 135/67 X |
| 3,554,585 | 1/1971 | Sorenson | 248/408 X |
| 3,752,476 | 8/1973 | Mahoney | 248/413 X |
| 3,768,495 | 10/1973 | Smith | 135/69 X |

*Primary Examiner*—Werner H. Schroeder
*Assistant Examiner*—Conrad L. Berman
*Attorney, Agent, or Firm*—Richard C. Woodbridge

[57] ABSTRACT

A quad cane includes a stabilizing device for improving the strength and rigidity of the cane. The stabilizing device comprises a collar having an interior opening therein and a wing screw which is threadably received in a hole which communicates the interior opening of the collar to the exterior thereof. The collar is drive fit over the exterior hollow sleeve of the upper portion of the quad cane in such a way that the threaded hole is located opposite an aperture in the sleeve. By rotating the threaded wing screw downwardly it is possible to impinge against the inner tubular member and immobilize the outer hollow sleeve relative to the inner tubular member of the cane. The stabilizing device is typically used in conjunction with a spring-loaded push button which serves to help adjust the height of the quad cane.

2 Claims, 5 Drawing Figures

QUAD CANE

CROSS-REFERENCE TO RELATED APPLICATIONS

This application is a continuation-in-part application of my copending application, Ser. No. 683,978 filed May 6, 1976 now U.S. Pat. No. 4,056,115, and entitled "An Adapter for Manipulating a Spring-Loaded Pushbutton", the entire disclosure of which is hereby incorporated by reference.

BACKGROUND OF THE INVENTION

1. Field of the Invention

This invention relates to an improved cane for assisting individuals with walking disabilities.

2. Description of the Prior Art

The use of walking canes to assist individuals having walking disabilities is well known to those of ordinary skill in the art. Recently such canes have been constructed of strong and lightweight metals such as anodized aluminum. Some modern metal canes are equipped with devices so that the length of the cane can be adjusted. Adjustability is desirable so that one cane can be used for a variety of different individuals and their needs. In some modern canes the adjustability is accomplished through the means of a spring-loaded pushbutton which will engage a plurality of apertures located in the circumference of a telescoping outer sleeve. In another type of adjustable walking cane the height adjustment is made by means of a single bolt which impinges against an inner shaft. The bolt must be tightened with a wrench. The use of such adjusting devices has greatly expanded the utility of modern canes but has also made them less rigid. Rigidity is especially important if an individual is to depend upon the cane for support. One basic reason for the lack of rigidity in modern adjustable canes is that the inner and outer telescoping portions are not precise fits. Therefore, there is a tendency for the outer hollow sleeve portion to pivot slightly around the spring-loaded pushbutton which emerges from the inner tubular portion. This in turn produces a highly undesirable wobble. The present invention comprises a device which when used on a cane such as that described above will greatly increase its rigidity and eliminate rattling noise.

The prior art does disclose some attempts to solve the problems of rigidity and rattling noise. For example, Guardian Products Company, Inc. of North Hollywood, Calif. 91605 manufactures a cane entitled a "Quadripoise Cane"® which includes a push button height adjustment and an independent stabilizing means. The stabilizing means comprises a screw down type of nut which compresses a split ferrule to immobilize the upper section of the cane relative to the lower section. The action is similar to the manner in which the telescopic legs of a camera tripod are adjusted. For a variety of reasons that apparatus is believed to be less economical and effective than the invention disclosed herein.

SUMMARY OF THE INVENTION

Briefly described, the invention comprises an adjustable cane including an inexpensive and effective means for eliminating the undesirable wobble frequently associated with adjustable canes. The quad cane itself includes an upper section and a lower section which telescopes into the upper section. The upper section comprises a handle portion with a hollow sleeve attached thereto. A plurality of locking apertures run along a portion of the length of the hollow sleeve. The lower section comprises a tubular member which is received in the hollow sleeve of the upper section and a foot portion. According to the preferred embodiment, the foot portion comprises four rubber-tipped feet. The tubular member houses a spring-loaded pushbutton which is adapted to pop through apertures in the hollow sleeve thereby locking the hollow sleeve relative to the tubular member. A collar having a hollow interior is drive fit over the hollow outer sleeve. A threaded passageway communicates the interior opening in the collar with the exterior of the collar. A threaded wing screw-like means having a flattened head to allow easy hand manipulation is threaded into the threaded passageway in the collar. The threaded passageway is lined up directly opposite an aperture in the hollow outer sleeve. By tightening down on the wing-type screw, it is possible to impinge upon the inner tubular member through the aperture in the hollow outer sleeve. In this manner, the hollow outer sleeve is firmly stabilized with respect to the inner tubular member. In the preferred embodiment of the invention, the stabilizing device is located at a point near the end of the hollow outer sleeve toward the base of the cane itself. The interior opening of the collar includes three sections. The first section is a cut-out portion which acts as a countersunk area so that the screw can be withdrawn or advanced. The second section of the collar comprises the portion having an effective diameter slightly less than the outside diameter of the hollow outer sleeve so that a drive fit can be obtained. The third portion of the inner opening of the collar in the relief section allows the metal in the outer hollow sleeve to flow when it is driven into the collar itself. The screw means is also equipped with a stop means preferably comprising a deformed portion of the threads on the screw. The stop means prevents the screw from being inadvertently threaded out of the collar. These and other features of the present invention will be more fully understood with respect to the following drawings and detailed description of the invention.

DETAILED DESCRIPTION OF THE INVENTION

During the course of this description, like numbers will be used to refer to like elements according to the different figures illustrating the invention.

Figure 1:
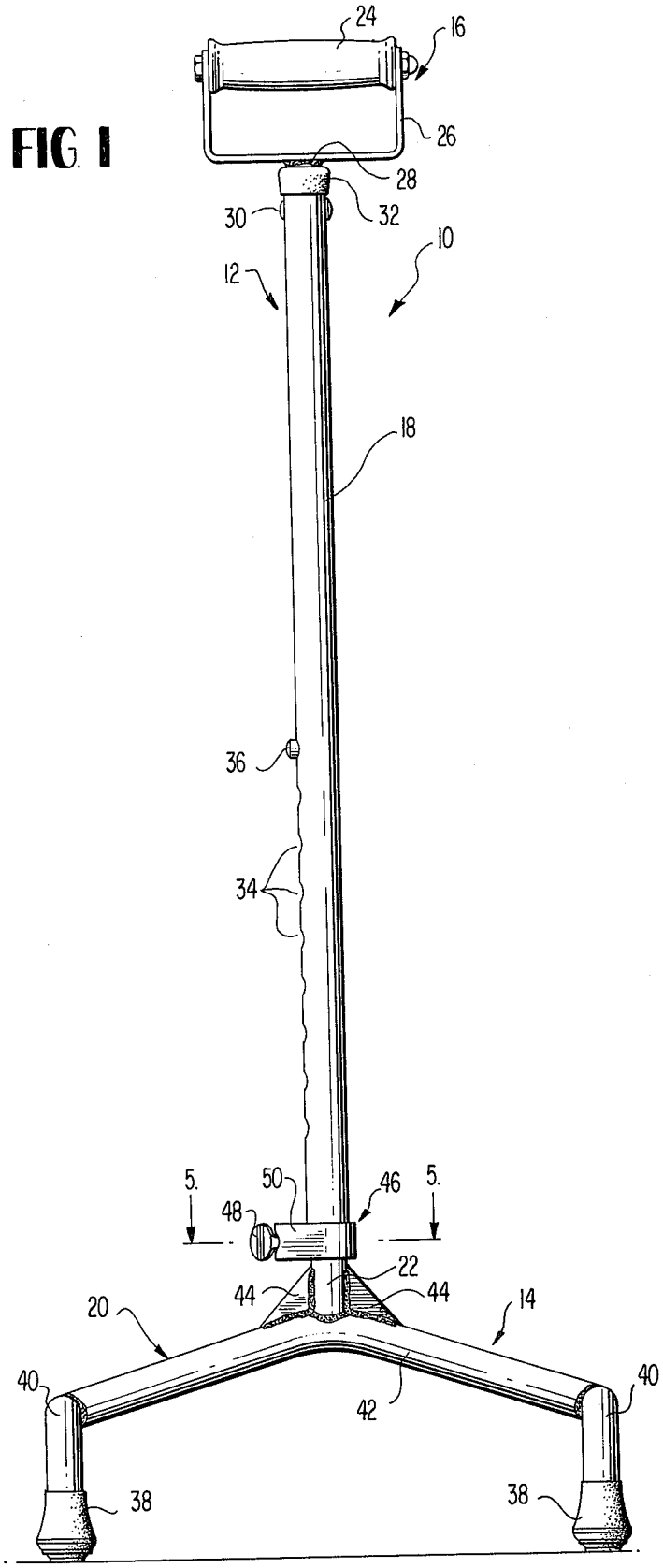
FIG. 1 is a front elevational view of an improved quad cane according to a preferred embodiment of the present invention.
Figure 2:
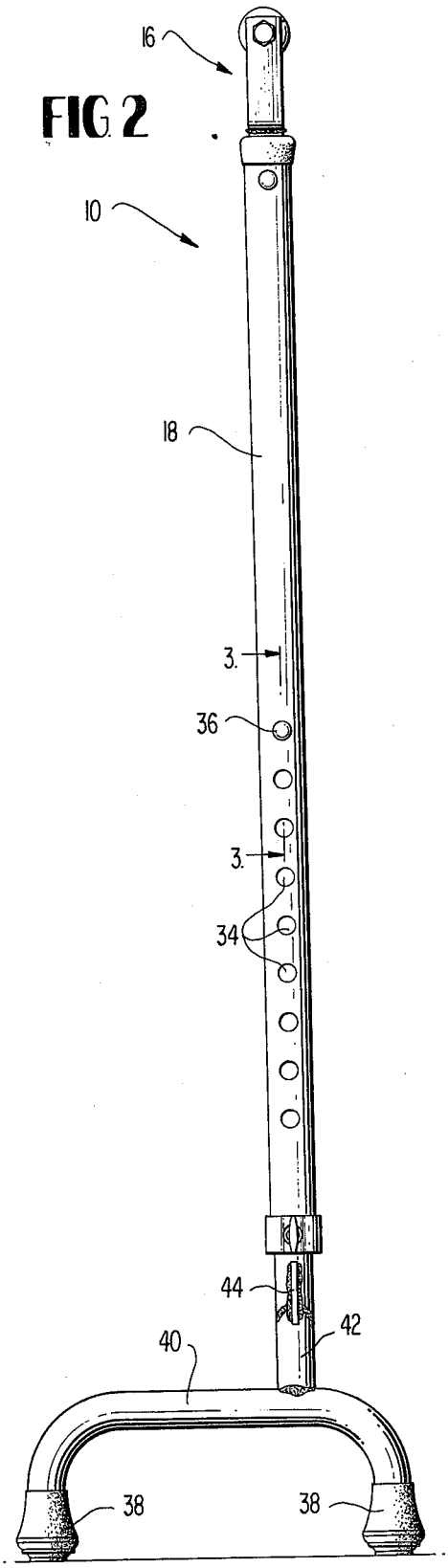
FIG. 2 is a side elevational view of the quad cane illustrated in FIG. 1.

A quad cane 10, according to the preferred embodiment of the present invention, is illustrated in FIGS. 1 and 2. The quad cane 10 includes an upper section 12 and a lower section 14. The upper section 12 principally comprises a handle portion 16 attached to a hollow sleeve 18. The lower section 14 includes a foot portion 20 and a hollow tubular portion 22 which telescopes into hollow sleeve 18 of the upper portion 12.

The handle portion 16 of the upper section 12 includes a wooden rubberized grip 24 fastened to the hollow sleeve 18 by a forked bracket 26. Forked bracket 26 is welded to a rounded stud 28 which fits into the cavity of the hollow sleeve 18. A rivet 30 passes through hollow sleeve 18 and stud 28 thereby securing the handle portion 14 firmly to the sleeve portion 18 of the upper section 12. A small plastic collar 32 helps to secure the handle portion 16 to the hollow sleeve 18. Hollow sleeve 18 also includes a plurality of locking apertures 34 which are adapted to engage with spring-loaded locking button 36. Details of the spring-loaded locking button 36 will be more fully appreciated with reference to FIG. 3. A similar spring-loaded locking button is disclosed in my pending application, Ser. No. 683,978 filed on May 6, 1976.

The foot portion 20 of the lower section 14 is terminated in four rubber or rubber-like feet 38. A pair of U-shaped leg brackets 40 connect the rubber tips 38 together in pairs. The two U-shaped brackets 40 are in turn welded to opposite ends of a V-shaped connecting bar 42. Connecting bar 42 is in turn welded to the upright hollow inner member 22. A pair of reinforcing gussets 44 are welded to the interface between connecting bar 42 and hollow upright member 22 in order to add additional support at that junction. As shown in FIG. 2, it will be appreciated that the connecting bar 42 does not connect the U-shaped brackets 40 at their mid-points. Rather, connecting bar 42 is offset to one side. Typically, a user of the quad cane employs the cane such that the shorter section of the connecting bracket 40 faces his body and the longer section of connecting bracket 40 faces away from the body. This feature gives additional clearance for the feet, while at the same time provides for sufficient support for the body.

Located at or near the extreme end of hollow sleeve 18 is a stabilizing device 46. The stabilizer 46 serves to increase the rigidity of the quad cane by securely fastening the lower end of the hollow sleeve 18 to the inner, upright hollow tube 22. The stabilizer 46 includes a wing type screw 48 and a hollow collar 50. The details of the stabilizer 46 will be more fully understood with reference to FIGS. 4 and 5 which will be discussed subsequently.

Figure 3:
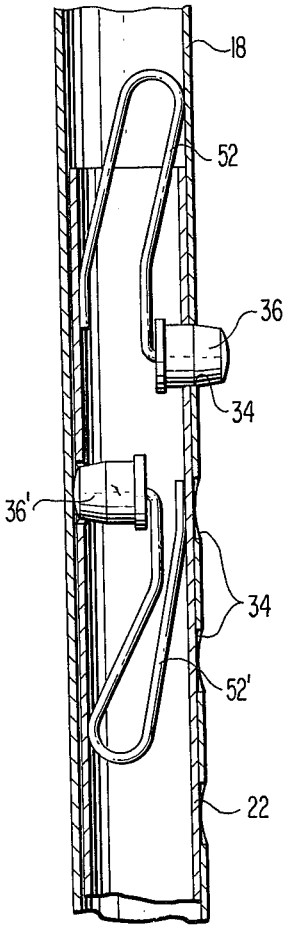
FIG. 3 is a cross-sectional view of the spring-loaded locking button used to adjust the length of the cane.

Details of the spring-loaded locking button 36 are shown in FIG. 3. The locking button 36 is biased outwardly by a wire spring 52 located within the hollow cavity of the upright inner tubular member 22. The height of the quad cane 10 can be adjusted by first depressing the push button 36 below the level of the inside diameter of the outer hollow sleeve 18. That effectively unlocks the inner tubular means 22 from the outer hollow sleeve 18 provided, of course, that the stabilizer 46 is likewise unlocked. The two telescoping members 18 and 22 are then either drawn apart or pushed together until a desired height is found. The quad cane illustrated in FIGS. 1 and 2 is shown in its most shortened state. The locking button 26 is then allowed to pop out through whichever locking aperture 24 is closest to the desired height. The domed head and the tapered shaft of the locking button 36 are features of the button which allow it to operate more effectively. Locking buttons such as those illustrated as element 36 in FIG. 3 are also used in other devices including but not limited to, folding walkers and the like. According to the preferred embodiment of the present invention, there are nine locking apertures or detents 34 which the spring-loaded locking button 36 may engage. It will, however, be appreciated by those of ordinary skill in the art that the number of locking apertures is not a critical limitation of the present invention. Typically, a sufficient number of locking apertures 34 are provided so that the quad cane 10 can be adjusted to any one of a variety of suitable heights.

A second button 36' and associated wire spring 52' are illustrated just below the first locking button 36 and wire spring 52. Second button 52' may be optional and serves to provide additional bias between the two telescoping members 18 and 22.

Figure 4:
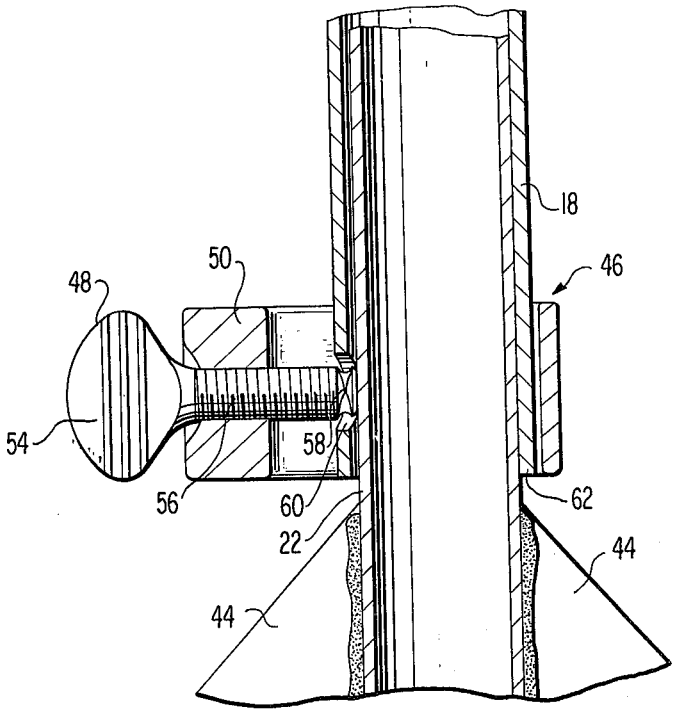
FIG. 4 is a cross-sectional view of the quad cane stabilizing device.
Figure 5:
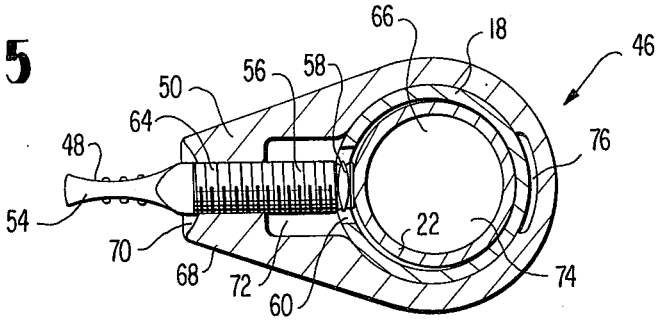
FIG. 5 is another cross-sectional view of the quad cane stabilizing device as seen from another perspective.

The quad cane stabilizer 46 is seen in two cross-sectional detailed views in FIGS. 4 and 5. The wing screw 48 includes a flat head portion 54, a threaded shaft 56, and a stop means 58. The stop means 58 typically comprise a section of the threaded shaft 56 which is flattened and deformed so that the screw 58 cannot back all the way out of collar 50. FIGS. 4 and 5 illustrate the stabilizer 46 in its locking mode. In this mode the shaft 56 of the wing screw 48 impinges upon the inner tubular member 22. In so doing, the shaft 56 passes through an aperture 60 located in the wall of the hollow sleeve 18. Aperture 60 is similar to locking apertures 34 except that it is located very close to the end 62 of the hollow sleeve 18.

Screw shaft 56 is received in a threaded hole 64 which communicates the interior 66 of the stabilizer 46 with the exterior 68 thereof. A small dished out or counter-sunk section 70 is included in the exterior 68 of the stabilizer 46 to accomodate the head portion 54 of the wing screw 48. The head portion 54 is slightly bowed so that it may be manipulated with the fingers. In this manner, special tools are not required to advance and retract the screw.

As clearly shown in FIG. 5, the interior 66 of the collar 50 includes three distinct and separate sections. The first section 72 serves several important functions. First of all, it allows the user of the cane to visually determine whether or not the screw shaft 56 is in stabilizing abuttment with the inner tubular shaft 22. This is important because it allows the user of the cane to quickly and efficiently determine whether the stabilizer 46 is in the stabilizing state. Second of all, the cutout section 72 is important because it allows the shaft 56 to be withdrawn from stabilizing engagement with inner tubular means 22 without being completely removed from collar 50. As previously discussed, the shaft 56 cannot be removed from the collar 50 due to the stop means 58 located near the abutting tip of the shaft 56. Finally, the cutout section 72 is important because it allows the stop means 58 to be easily and quickly added to the threaded shaft 56. Typically, the stop means 58 comprises two or three threads of the shaft 56 which have been flattened in such a manner that they cannot be unthreaded through threaded hole 64. In the preferred embodiment, the shaft 56 is flattened on four sides. The flattening of the threaded shaft 56 is easily accomplished once the wing screw 48 has been threaded into the receiving hole 64. The flattening may be accomplished by hammering a portion of the shaft 56 against an appropriate anvil. This technique is only possible because the cutout section 72 provides sufficient clearance room in which to perform the necessary operations upon the threaded shaft 56. It is likely that any other approach would require special countersinking and an extraneous hole through 76 which would weaken the structure. Accordingly, the cutout section 72 performs several important though not necessarily directly related functions.

The second section 74 of the inner cavity 66 comprises an approximately annular opening with an effective diameter that is slightly less than the outside diameter of the hollow sleeve 18. Accordingly, it is possible to drive fit the collar 50 over the hollow outer sleeve 18 by driving the collar 50 against end 62 of the hollow sleeve 18. When correctly aligned, the aperture 60 of the hollow sleeve 18 opens directly into the first section 72 of interior cavity 66. Hole 60 is of a smaller diameter than locking holes 34 in order to prevent the button 36 from emersing from under the collar 50 where it would be inaccessible for release.

The third section 76 of the interior cavity 66 provides relief for the hollow outer sleeve 18 when it is drive fit into the second section 74 of the interior cavity 66. During assembly a small portion of the hollow outer sleeve 18 actually deforms and flows into the cavity 66. This allows the collar 50 to be more readily attached to the hollow outer sleeve 18. A drive fit is highly desirable because it does not require additional attaching steps such as welding or riveting and the like.

A collar 50 similar to the one described in detail in FIGS. 4 and 5 is used in another context as described in my copending application, Ser. No. 683,978 filed May 6, 1976, the disclosure of which is incorporated herein by reference. According to the invention described in that application, a similar collar is used as part of an adapter for manipulating a spring-loaded push button such as that illustrated in FIG. 3.

In the stabilizing mode, the spring-loaded pushbutton 36 is typically engaged in its locking position as illustrated in FIG. 3. The wing screw 48 is then tightened against the inner shaft 22 until it can't be tightened any more. Tightening is accomplished by turning the flat head 54 of the screw 48 in an appropriate direction so that the threaded shaft 56 advances against and impinges upon the inner tubular shaft 22. Once the screw 48 has been tightened so that it can advance no further, the inner shaft 22 is effectively immobilized against the outer hollow sleeve 18. The immobilization or stabilization is accomplished because the hollow sleeve 18 is rigidly connected to the collar 50 which is in turn firmly connected to wing screw 48 which in turn firmly impinges upon the inner tubular shaft 22. This produces two points of contact. The first point of contact takes place between the threaded shaft 56 and the inner tubular shaft means 22. The second point of contact takes place opposite the first point of contact where the inner tubular shaft means 22 is pushed up against the inside diameter of the hollow outer sleeve 18. In the locking mode, the bottom of the shaft cannot wobble or move with respect to any other portion of the cane. If the stabilizing means 46 were not employed in the manner disclosed, then the hollow outer shaft 18 would be free to jiggle or wobble with respect to the inner tubular shaft means 22. In effect, the hollow outer sleeve 18 would attempt to rotate around the locking button 36 which acts as a fulcrum if otherwise unrestrained.

In order to adjust the height of the quad cane 10, the wing screw 48 is withdrawn from contact with the inner tubular shaft means 22 by manually rotating the flat head 54 in such a direction as to retract the shaft 56. Spring-loaded locking button 36 is then depressed and the telescoping tubular members 18 and 22 are either pulled apart or pushed together until the desired height is obtained at which point the spring-loaded push button 36 is allowed to pop into the appropriate locking aperture 34 which most closely approximates the desired height. Wing screw 48 is then tightened in a manner previously described so as to stabilize the apparatus.

In the preferred embodiment, the long dimension of the stabilizer 46 lies in a plane parallel to the long dimension of connecting bar 42. In this manner the wing screw 48 and its associated collar 50 are least likely to snag on clothing and other objects.

It is generally desirable to make walking canes and related devices out of strong and lightweight materials. According to the preferred embodiment of the present invention, the lower section 14 of the cane 10 is made from a chrome coated steel material with the exception of the rubber-like tips 38. The hollow sleeve 18 is preferably made from aluminum tube which may or may not be annodized. Collar 50 likewise comprises an aluminum material but the wing screw 48 is preferably made from an appropriate type of steel. The forked bracket 26 and its associated stud 28 are made of a strong steel and are attached to the grip 24 by means of a long steel bolt which passes through the center of the grip 24 and a capping nut. The grip 24 is preferably made of wood but of course, could be made from any suitable plastic or rubber-like materials. Spring-loaded locking button 36 is preferably made from aluminum but of course could be made from other materials such as steel and the like. Generally, the choice of materials utilized in the construction of this particular invention are believed to be conventional materials of the sort typically used for such applications.

There are several modifications to the present invention which can be made without departing from the spirit thereof. For example, there are many different materials known to those of ordinary skill in the art which can be substituted for the materials used in this specific embodiment. Also, while the preferred embodiment illustrates the use of nine locking apertures, it will be appreciated that a smaller or greater number of locking apertures could also be successfully employed. The cane illustrated in FIGS. 1 and 2 is known as a quad cane in the trade because of its four feet. While a quad cane has been discussed as a preferred embodiment of the present invention, it will be appreciated by those of ordinary sill in the art that stabilizing device 46 can also be employed with canes having one foot, two feet, three feet, or perhaps more than four feet.

While the invention has been described with reference to a preferred embodiment thereof, it will be appreciated by those of ordinary skill in the art that various changes in the form and structure of the parts can be made without departing from the spirit and scope of the present invention.

I claim:

1. A quad cane apparatus comprising:

an upper section having a handle and a hollow sleeve attached thereto, said hollow sleeve including a plurality of apertures therein;

a lower section including a tubular means received by said hollow sleeve in an interlocking telescoping relationship;

a foot portion attached to said tubular means, said foot portion including four feet having rubber-like tips;

a locking means for locking said hollow sleeve relative to said tubular means, said locking means comprising a spring-loaded button at least partially housed inside of said tubular means, said spring-loaded button being adapted to pop through one of said apertures in said hollow sleeve; and, a stabilizing means including:

a collar attached to said hollow sleeve, said collar including a threaded hole therethrough, said threaded hole being located opposite one of said apertures in said hollow sleeve; and, a connecting means for selectively connecting said collar to said tubular means through at least one of said apertures in said hollow sleeve, said connecting means comprising a wing-type threaded screw-like means threadably received in said threaded hole, the threads of said threaded screw-like means including a stop means thereon so that said threaded screw-like means cannot back out of said threaded hole, said collar further including a first section through which a portion of said threaded screw-like means is visible, a second approximately annular section with a diameter slightly less than the outside diameter of said hollow sleeve, and a third relief section for accomodating the flow of said hollow sleeve when said apparatus is assembled on said hollow sleeve.

2. The apparatus of claim 1 wherein said stop means on said threaded screw-like means comprises a portion of said threaded screw-like means which is deformed.

* * * * *